US008157339B2

(12) United States Patent
Park et al.

(10) Patent No.: US 8,157,339 B2
(45) Date of Patent: Apr. 17, 2012

(54) BASKET ASSEMBLY AND BASKET CARRIER FOR REFRIGERATOR

(75) Inventors: Jin-Woo Park, Changwon (KR); Do-Hyung Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 188 days.

(21) Appl. No.: 12/442,675

(22) PCT Filed: Oct. 23, 2007

(86) PCT No.: PCT/KR2007/005218

§ 371 (c)(1),
(2), (4) Date: Jul. 24, 2009

(87) PCT Pub. No.: WO2008/051004

PCT Pub. Date: May 2, 2008

(65) Prior Publication Data

US 2010/0007256 A1 Jan. 14, 2010

(30) Foreign Application Priority Data

Oct. 25, 2006 (KR) ..... 10-2006-0104113
Oct. 27, 2006 (KR) ..... 10-2006-0105288

(51) Int. Cl.
*A47B 96/04* (2006.01)

(52) U.S. Cl. ..... 312/404; 312/331

(58) Field of Classification Search ..... 312/402, 312/404, 408, 334.7, 334.8, 334.21, 331, 312/401, 228.1, 311; 211/151, 126.15, 41.4, 211/133.5, 126.9, 41.8, 41.9; 220/485; 16/2.1, 16/2.2, 108, 109; 134/201
See application file for complete search history.

(56) References Cited

U.S. PATENT DOCUMENTS 3,245,572 A * 4/1966 Mashy et al. ..... 312/109
3,288,302 A * 11/1966 Fitzpatrick et al. ..... 211/41.8
3,323,853 A * 6/1967 Stark ..... 312/331
3,679,282 A * 7/1972 Kauffman ..... 312/311
3,761,153 A * 9/1973 Guth ..... 312/351
3,794,401 A * 2/1974 Dean et al. ..... 312/323
4,057,872 A * 11/1977 Schmidt ..... 16/29
4,226,490 A * 10/1980 Jenkins et al. ..... 312/331
4,437,715 A * 3/1984 Jenkins ..... 312/228.1

(Continued)

FOREIGN PATENT DOCUMENTS

CN 1330759 A 1/2002

(Continued)

*Primary Examiner* — Darnell Jayne
*Assistant Examiner* — Hiwot Tefera
(74) *Attorney, Agent, or Firm* — Birch, Stewart, Kolasch & Birch, LLP

(57) ABSTRACT

In order to increase the reliability of the parts constituting the basket and to conveniently use the basket and to stably accomplish the operation of the basket, as the shaking of the basket is prevented, there is disclosed a basket operation device of a refrigerator, comprising: a basket freely moved in a back-and-forth direction in the state that the basket is supported by an inner wall of the refrigerator; a rotation shaft supported by the basket and moved with the basket and respectively rotated; a pair of rotation elements supported by both sides of the rotation shaft and rotated at the same angle to guide a movement of the basket when the basket moves in a back-and-forth direction; and a corresponding element formed in the inner wall of the refrigerator in a back-and-forth direction to contact with the rotation elements.

7 Claims, 4 Drawing Sheets

U.S. PATENT DOCUMENTS 4,470,642 A * 9/1984 Gasperin ..... 384/19
4,526,419 A * 7/1985 Bowman et al. ..... 297/153
5,303,997 A * 4/1994 Kropf ..... 312/334.4
5,409,309 A * 4/1995 Giddings et al. ..... 312/331
5,474,378 A * 12/1995 Smith et al. ..... 312/334.4
6,491,173 B1 * 12/2002 Costa ..... 211/126.15
6,499,818 B2 * 12/2002 Brustle ..... 312/319.1
6,641,239 B2 * 11/2003 Kaiser ..... 312/404
6,851,775 B2 * 2/2005 Kaiser ..... 312/404
7,384,108 B2 * 6/2008 Lam et al. ..... 312/334.44
7,430,937 B2 * 10/2008 Rotter et al. ..... 74/422
7,594,707 B2 * 9/2009 Kunkle et al. ..... 312/402
7,677,125 B2 * 3/2010 Rotter ..... 74/422
7,712,852 B2 * 5/2010 Choi et al. ..... 312/402
7,815,265 B2 * 10/2010 Lee ..... 312/228.1
7,997,667 B2 * 8/2011 Rotter et al. ..... 312/402
2001/0054296 A1 12/2001 Kaiser
2003/0067257 A1 * 4/2003 Gasser ..... 312/331
2003/0189395 A1 * 10/2003 Doornbos et al. ..... 312/334.1
2005/0160854 A1 * 7/2005 Rotter ..... 74/422
2006/0152118 A1 * 7/2006 Lee ..... 312/404
2006/0152119 A1 * 7/2006 Park ..... 312/404
2008/0054772 A1 * 3/2008 Koloff et al. ..... 312/404
2008/0314067 A1 * 12/2008 Lee ..... 62/441
2009/0045713 A1 * 2/2009 Kunkle et al. ..... 312/402
2009/0248205 A1 * 10/2009 Yu et al. ..... 700/275
2009/0261698 A1 * 10/2009 Cabal Velarde et al. ... 312/334.8
2009/0289537 A1 * 11/2009 Cabal Velarde et al. ..... 312/408
2009/0302728 A1 * 12/2009 Rotter et al. ..... 312/404
2009/0322196 A1 * 12/2009 Park ..... 312/404

FOREIGN PATENT DOCUMENTS

KR 1998-043774 U 9/1998
KR 10-2002-0017015 A 3/2002
KR 10-0634361 B1 10/2006

* cited by examiner

[Fig. 1]
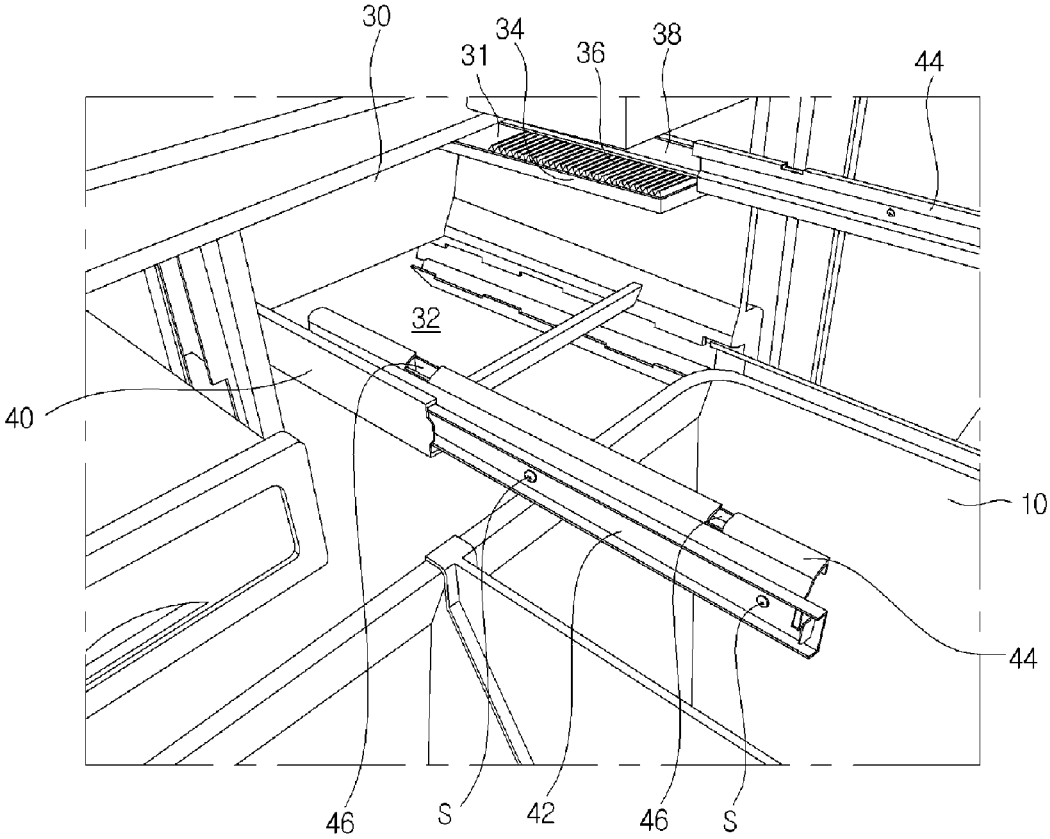
[Fig. 2]
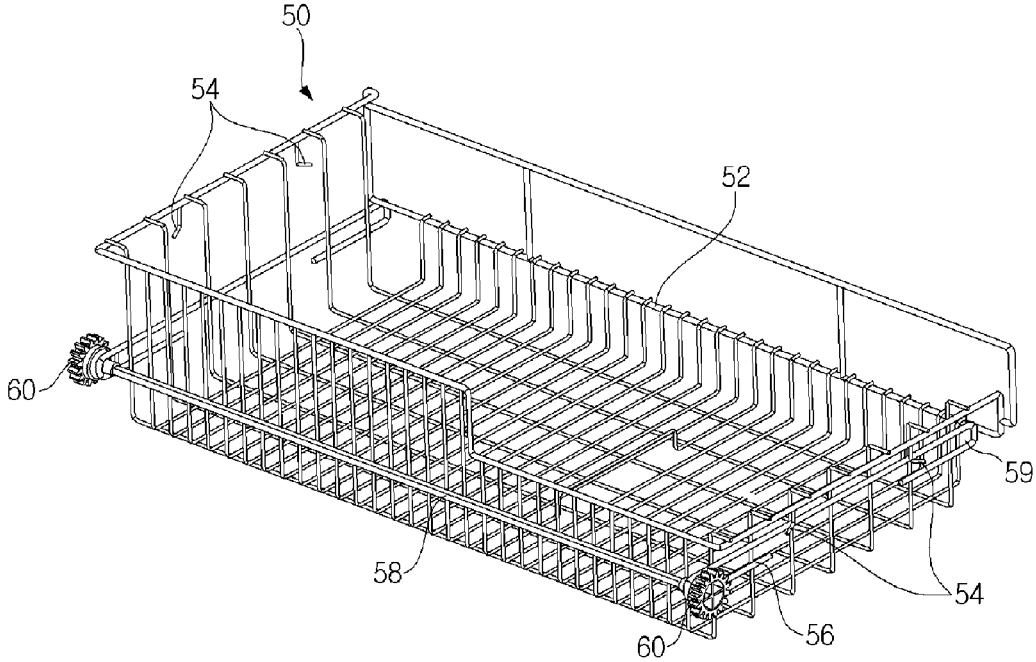

[Fig. 3]
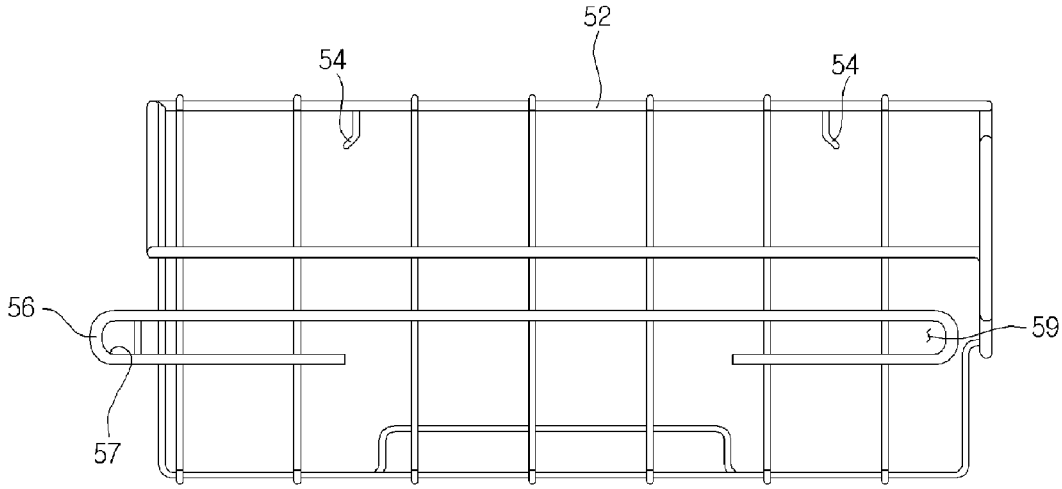
[Fig. 4]
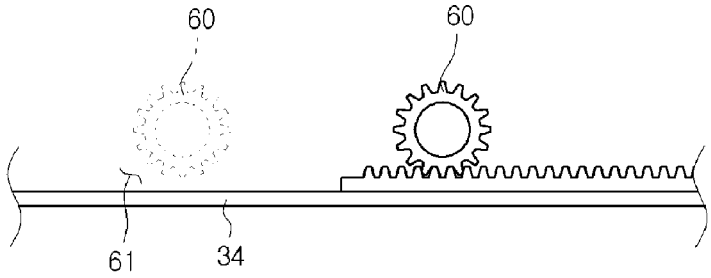
[Fig. 5]
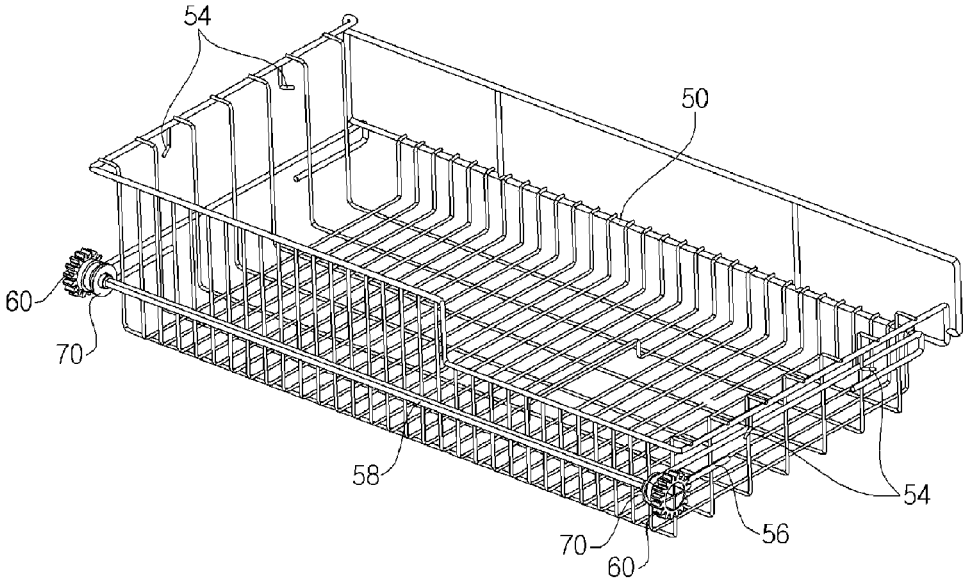

[Fig. 6]
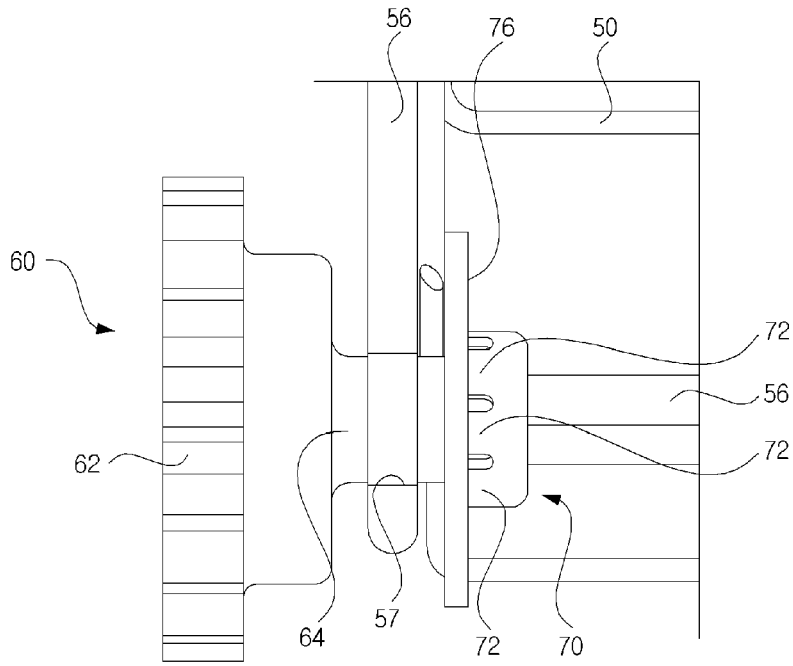
[Fig. 7]
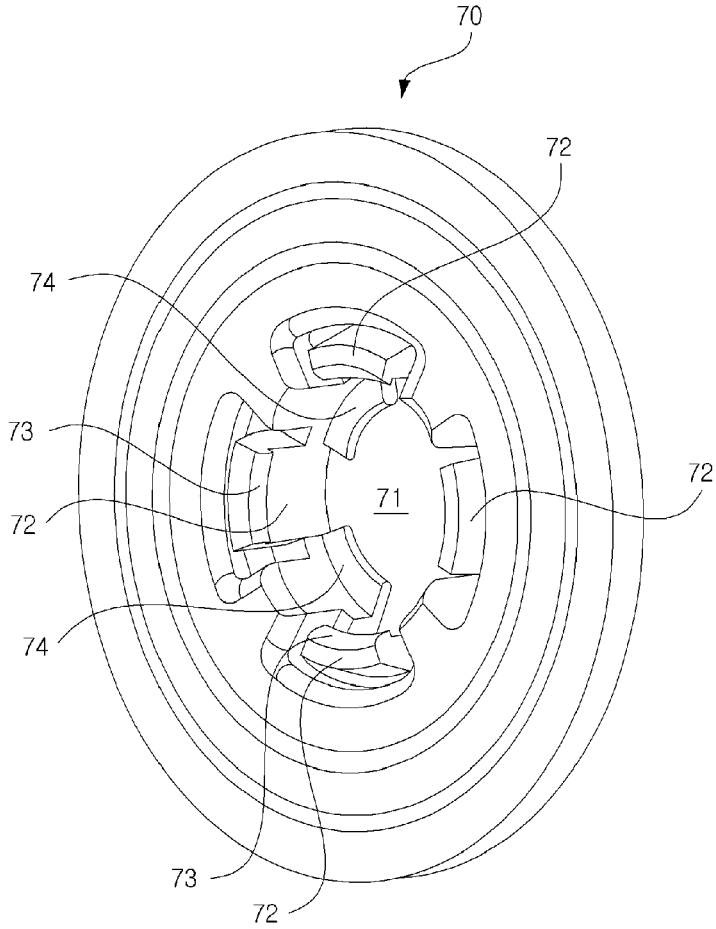

[Fig. 8]
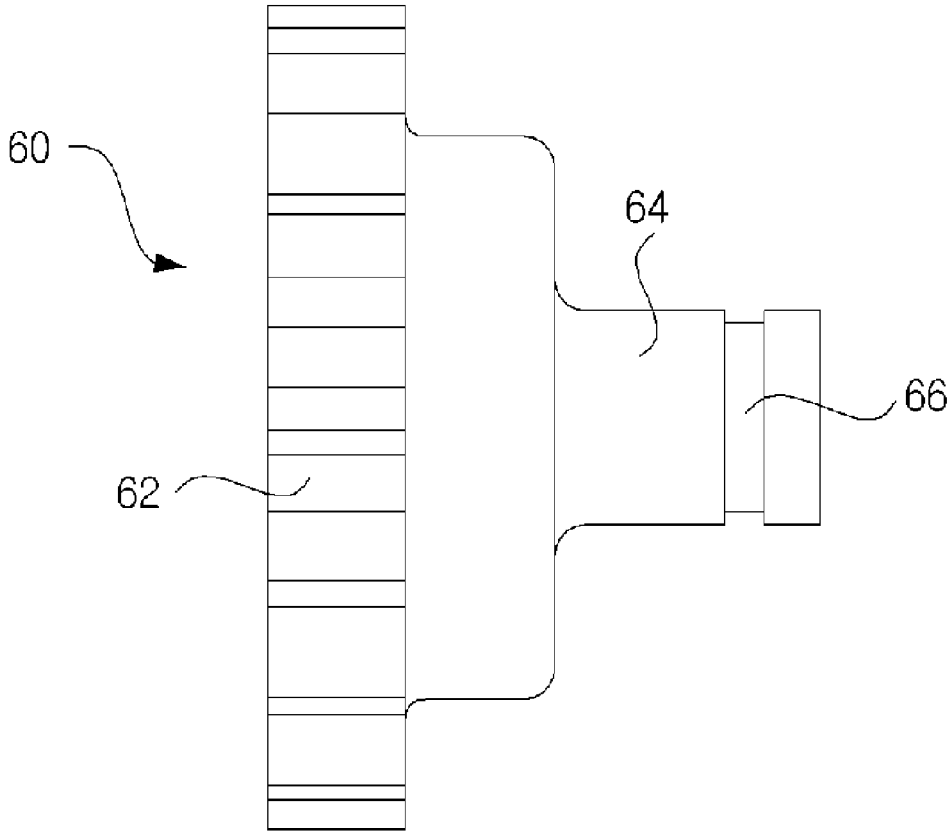

BASKET ASSEMBLY AND BASKET CARRIER FOR REFRIGERATOR

TECHNICAL FIELD

This document relates to a basket assembly and a basket operation device of a refrigerator.

BACKGROUND ART

Baskets are a container to be stored with objects. These baskets are also applied to a refrigerator. The present invention relates to a basket assembly and a basket operation device of a refrigerator, which are installed in an installing apparatus, for example a refrigerator, in a state that foods are stored in the basket and they are moved in back-and-froth direction, so that users may easily take in and out.

Meanwhile, in contrast to typical baskets, a basket installed in a refrigerator is supported by a product of a plastic material which constitutes an inner wall of the refrigerator and it is frequently pulled out by an user. Therefore, a design corresponding to these characteristics is required.

As a conventional structure that pulls out the basket installed in the refrigerator, there is a structure which uses a hook provided in both sides of the basket and a telescopic formed in the inner wall of the refrigerator to catch the hook.

However, according to this structure, there is a problem that a covering of a wire constituting the basket is cut off by an excessive shaking of the basket during the movement of the basket. And, there is another problem that it is unconvenient for the user to use the basket, since the basket is distorted from side to side due to the unbalance of the movement of both sides during the telescopic moves.

DISCLOSURE OF INVENTION

Technical Problem

An object of the present invention is to provide a basket assembly and a basket operation device that prevent the basket from shaking during the movement of the basket, that allow the user to easily use them by adjusting the balance of both sides when taking out the basket, and that extend the life time of the basket by preventing an external covering of the basket from being peeled off.

Technical Solution

A basket assembly according to a preferred embodiment of the present invention includes a frame providing a food storage space; a rotation shaft rotatably supported on the frame; a pair of rotation elements supported by both sides of the rotation shaft, wherein the pair of rotation elements contact with each of corresponding elements to rotate together with each other so that they guide a movement of the frame when the frame moves in a back-and-forth direction; and a hanger wire formed in both sides of the frame to support the self weight of the frame.

A basket assembly according to another preferred embodiment of the present invention includes a frame providing a food storage space; a support element connected to the frame and providing a support hole opened in a cross direction with reference to an in-and-out direction of the frame; a rotation shaft inserted into the support hole and rotatably supported on the frame; a pair of rotation elements supported by both sides of the rotation shaft, and contacted with each of corresponding elements to rotate together with the corresponding elements; a shaking prevention cap tightly connected with the rotation elements via the support element which is interposed therebetween; and a hanger wire formed in both sides of the frame to support the self weight of the frame.

A basket operation device of a refrigerator according to a preferred embodiment of the present invention includes a basket providing a food storage space and freely pushed in and pulled out of the refrigerator; a hanger wire fastened to the basket; a telescopic supported by the hanger wire and extended inside the refrigerator in a back-and-forth direction; a rotation shaft supported by the basket and moved with the basket, and respectively rotated; a pair of rotation elements supported by both sides of the rotation shaft and rotated at the same angle to guide a movement of the basket when the basket moves in a back-and-forth direction; and a corresponding element formed into the refrigerator in a back-and-forth direction to contact with the rotation elements.

A basket operation device of a refrigerator according to another preferred embodiment of the present invention includes a basket freely moved in a back-and-forth direction in the state that the basket is supported by an inner wall of the refrigerator; a rotation shaft supported by the basket and moved with the basket, and respectively rotated; a pair of rotation elements supported by both sides of the rotation shaft and rotated at the same angle to guide a movement of the basket when the basket moves in a back-and-forth direction; and a corresponding element formed in the inner wall of the refrigerator in a back-and-forth direction to contact with the rotation elements.

A basket operation device of a refrigerator according to further another preferred embodiment of the present invention includes a basket freely moved in a back-and-forth direction in the state that the basket is supported by an inner wall of the refrigerator; a rotation shaft moved with the basket in a back-and-forth direction; a pair of rotation elements supported by both sides of the rotation shaft and rotated at the same angle to guide a movement of the basket when the basket moves in a back-and-forth direction; a support wire supporting the rotation elements; a corresponding element formed at the inner wall of the refrigerator in a back-and-forth direction in order to guide the rotation elements; and a pair of shaking prevention caps provided to maintain the relative position between the rotation element and the support wire.

Advantageous Effects

According to the present invention, shaking of a basket is prevented, and as a result reliability of parts constituting the basket is increased, stable motion of the basket is possible, and users may take in and out the basket with a comfortable motion.

BRIEF DESCRIPTION OF THE DRAWINGS

FIG. 1 is a perspective view showing an inside of a refrigerator according to the preferred embodiment of the present invention.

FIG. 2 is a rear perspective view of a basket according to the preferred embodiment of the present invention.

FIG. 3 is a side view of a basket according to the preferred embodiment of the present invention.

FIG. 4 is a view explaining relationship between a rack and a pinion.

FIG. 5 is a rear perspective view of a basket according to the preferred embodiment of the present invention.

FIG. 6 is a plan view showing a rotation shaft, a pinion, a support wire and a shaking prevention cap which are collected together.

FIG. 7 is a perspective view of a shaking prevention cap.

FIG. 8 is a plan view of a pinion according to the preferred embodiment of the present invention.

BEST MODE FOR CARRYING OUT THE INVENTION

The preferred embodiment of the present invention will be explained in detail with reference to the accompanying drawings.

First Embodiment

FIG. 1 shows an inside of a refrigerator according to this embodiment of the present invention in a perspective view.

Referring to FIG. 1, a low temperature storage space 32 having a predetermined height and width is formed in a refrigerator main body 30 forming an exterior of the refrigerator. On both sides of the storage space 32, a pair of support 34 is formed so that they are faced to each other. The support 34 is a portion to which a fixing rail 38 is fastened and supported. At least one side of the support 34 is supported by an inner wall of the refrigerator and at least one side of the support 34 is extended into a chamber of the refrigerator and protruded therefrom.

In the one side of the support 34 which is extended into a chamber of the refrigerator, a rack 36 which is extendable in a back-and-forth direction of the chamber is provided. The rack 36 is fastened with a pinion 60 (see FIG. 2).

The fixing rails 38 are secured to the supports 34, respectively. The fixing rails 38 are installed so that a external surface thereof is tightly contacted with an inner surface of the supports 34. The fixing rails 38 are longitudinally formed in the main body 30 in a back-and-forth direction. Also, a guide rail 40 is movably formed in an inner side of the fixing rails 38 in a back-and-forth direction. The guide rail 40 has a lateral cross-section which is opened to each other, and it is longitudinally formed in a back-and-forth direction of the main body 30.

Inside of the guide rails 40, moving rails 42 are movably formed in a back-and-forth direction, respectively. The moving rails 42 may forwardly move along the guide rails 42 in a state that the moving rails 42 are forwardly moved. Therefore, a basket may be drawn in a back-and-forth direction to a length corresponding to the length that the moving rails 42 and guide rails 40 can move. Therefore, a bearing structure may be provided in each contact surface of the respective rails. This freely extendable rail structure may be referred to as a telescopic.

In a surface of the moving rails 42 facing to each other, a basket rail 44 is respectively installed. The basket rail 44 is a portion in which a basket 50 is hooked, and it guides the basket 50 to draw in/out of the storage space 32 with a state that the basket 50 is hooked therein. The basket rail 44 is generally made of a plastic material. And, on a top of the basket rail 44, a hook hole 46 for connecting with the basket 50 is formed at a predetermined distance. The basket rail 44 may be fastened to the moving rail 42 by a screw S.

Finally, the basket 50 may be pulled/pushed in a back-and-forth direction with a state that a door 10 is opened and it is supported by the hook hole 46, and the draw distance may be the draw distance of the moving rail 42 and guide rail 40.

FIG. 2 shows a basket according to this embodiment of the present invention in a rear perspective view, and FIG. 3 shows a basket according to this embodiment of the present invention in a side view.

Referring to FIGS. 2 and 3, a frame 52 constituting the basket 50 has a shape that a plurality of wires are arranged in a specific distance and that the plurality of wires of which both ends are bent are connected to each other at right angles. In said frame 52, various foods, and bottles are received.

And, a hook wire 54 for hooking the basket 50 to basket rail 44 is provided in both sides of the frame 52. A pair of hook wires 54 are respectively provided in both sides of the frame 52 and downwardly protruded from the frame 52. In the hook wire 54, which is relatively disposed toward the front, of the hook wires 54, a tip thereof is downwardly inclined and formed at a predetermined angle toward the front of the frame 52. And, in the hook wire 54, which is relatively disposed toward the rear, of the hook wires 54, a tip thereof is downwardly inclined and formed at a predetermined angle toward the rear. By means of this structure, the shaking of the basket 50 is possibly prevented.

Meanwhile, according to the drawings, the height of both sides of the frame 52 is different, however the present invention is not restricted thereto and both sides of the frame 52 may be formed at the same height.

In both sides of the frame 52, a support wire 56 for supporting a rotation shaft 58 is provided. The support wire 56 is also composed of a wire and it is fastened to the frame 52. The support wire 56 is bent and formed to have a '⊏' shape, when it is viewed from the side. In this way, a rotation shaft hole 57 is formed between the wire constituting the frame and the support wire 56 by bending the support wire 56.

In the support wire 56, both ends of the rotation shaft 58 are rotatably installed. The rotation shaft 58 is passed through the rotation shaft hole 57 and installed thereto. And, a pair of pinions 60 are provided at the rotation shaft 58. The pinions 60 are provided on the peripheral surfaces adjacent to both ends of the rotation shaft 58. The pinions 60 are moved along the rack 36 in a back-and-forth direction when the moving rail 42 and the guide rail 44 moves in a back-and-forth direction.

Meanwhile, it is explained that the rotation shaft 58 is supported by a rear end of the support wire 56. However, the present invention is not restricted thereto, the rotation shaft may be supported by a front end of the support wire 56. In other words, it may be supported by a rotation shaft hole 59 provided at the front end of the support wire 56. In this case, it is easily expected that the position of the rack is also displaced.

FIG. 4 explains the relationship between a rack and a pinion, wherein a left side of the drawing is directed to the inside of the refrigerator, and a right side is directed to the outside of the refrigerator, i.e. the door.

Referring to FIG. 4, the rack 36 is not extended to an inner-most side of the support. In other words, an inner-most side end of the rack 36 which is extended to the inside of the refrigerator is positioned outside of the pinion 60 when the basket 50 is totally inserted therein. Finally, a gear-free portion 61, in which a rack 36 is not formed, is formed. An imaginary line of the drawing is the position where the pinion 60 is positioned when the basket 50 is totally inserted, the pinion 60 may be spinned thereon.

With this structure, even though a worker pushes the basket in a state that the balance of the left and right is not accurately adjusted, the pinions 60 of both sides are placed on a section (gear-free portion) where the rotation shaft 58 is spinned while the basket is completely inserted therein. And then, the basket may be completely inserted in a state that the balance of the left and right is adjusted without a restriction of the rotation shaft 58. Of course, the same action may be occurred while users push/pull the basket.

Hereinafter, the action and motion of the basket assembly and basket operation device of the refrigerator having this structure according to the embodiment of the present invention will be explained in detail.

The rotation shaft 58 is rotatably installed at not the rear of the moving rail 42 but the support wire 56. And, the frame 52 is installed so that it may be hooked in the basket rail 44 by the hook wire 54. Therefore, if the user draws the basket 50 out of the storage space 32, the rotation shaft 58 is moved together with the basket 50. After that, the left and right of the basket 50 may be outwardly drawn to the same amount by a control action of the rotation shaft 58, in particular the rack and pinion, and the same thing occurs when pushing the basket therein. That is, the basket 50 may be moved when it is completely fixed by the hook wire 54 and support wire 56.

In this manner, since the basket 50 is integrally moved with the rotation shaft 58 and pinion 60, shaking due to the movement of the frame 52 is prevented. And, since shaking, in particular shaking from side to side is prevented, the friction between the hook wire 54 and the hook hole 46 is reduced. Therefore, it is possible to prevent the covering of the hook and hook wire 54 from being peeled off.

Second Embodiment

The second embodiment of the present invention is large the same as the first embodiment, however the construction which more stably supports the rotation shaft is different to each other. Therefore, the same parts will be omitted, and the different or more specific parts will be explained in detail.

FIG. 5 shows a basket according to this embodiment of the present invention in a rear perspective view.

Referring to FIG. 5, the pinion 60 is disposed at one side and the shaking prevention cap 70 is disposed at the other side in a state that the support wire 56 is interposed therebetween. Here, the pinion 60 is the same as that of the first embodiment. However, since shaking of the rotation shaft 58, in particular the tooth coupling of the rotation shaft and rack is stably maintained and the movement from side to side is prevented by providing the shaking prevention cap 70, there is an advantage that the shaking of the basket 50 is further prevented.

Hereinafter, the relationship between the rotation shaft, the pinion, the support wire and the shaking prevention cap will be explained in detail.

FIG. 6 shows a rotation shaft, a pinion, a support wire and a shaking prevention cap collected together in a plan view, FIG. 7 shows a shaking prevention cap in a perspective view, and FIG. 8 shows a pinion according to this embodiment of the present invention in a plan view.

Referring to FIGS. 6 to 8, a gear 62 engaged with the rack 36 is provided on the peripheral surface of the pinion 60. And, a junction 64 to which one end of the rotation shaft 58 is connected is perpendicularly provided at one side of the pinion 60. The junction 64 is a portion in which one end of the rotation shaft 58 is inserted, and it is formed to have a diameter corresponding to that of the rotation shaft hole 57. The junction 64 is a portion which is substantialled inserted into the rotation shaft hole 57. Here, some of the junction 64 line-contact or surface-contact with the rotation shaft hole 57, and it can be supported only by the other area.

Also, in the area outside of the junction 64, a connection groove 66 (see FIG. 8) into which a fixing hook 72 (see FIG. 7) of the shaking prevention cap 70 is elastically deformed and inserted is formed along the peripheral surface.

The shaking prevention cap 70 for preventing the rotation shaft 56 from shaking from side to side in a state that the rotation shaft 56 and pinion 60 are mounted on the support wire 56 is connected to the pinion 60. The shaking prevention cap 70 is connected to the junction 64 at the position corresponding to the opposite side of the pinion 60, and therefore it prevents the rotation shaft 58 and the pinion 60 from shaking in a longitudinal direction of the rotation shaft 58. For this end, the shaking prevention cap 70 is formed to have a diameter relatively greater than that of the rotation shaft hole 57.

Some of a central portion of the shaking prevention cap 70 is opened and a through hole 71 is formed. And, a plurality of fixing hooks 72 having a predetermined elasticity are provided at one side of the shaking prevention cap 70 adjacent to the through hole 71. The fixing hooks 72 are provided around the through hole 71 so that they are spaced apart at an angle corresponding to an arc of a fan-shape having a predetermined central angle. And, a latch projection 73 which is inserted into the connection groove 66 is protruded in a centripetal direction and provided at the tip of the fixing hook 72.

On the inner peripheral surface of the through hole 71, a plurality of fixing ribs 74 are provided. The fixing ribs 74 are extended to the inside of the through hole 71 so that they are angularly spaced apart around the center of the through hole 71 at an angle corresponding to an arc of a fan-shape having a predetermined central angle. Here, the fixing ribs 74 are arranged in an alternate manner with the fixing hooks 72. The fixing ribs 74 prevent the shaking prevention cap 70 from excessively inserting into the junction 64, since they are formed to tightly contact with the tip of the junction 64.

Hereinafter, the operation of the basket assembly and basket operation device of the refrigerator having the above-described structure according to the embodiment of the present invention will be explained.

If the shaking prevention cap 70 is connected to the pinion 60, this prevents the rotation shaft 58 from shaking in its longitudinal direction, i.e. the horizontal direction of FIG. 6, during the in-and-out movement of the basket 50. Therefore, there was a problem that a gear surface formed in any one of the gears 62 is not completely engaged with the rack 36 if the rotation shaft 58 is moved to one side during the in-and-out movement of the basket 50, however this phenomenon is perfectly prevented by inserting the shaking prevention cap 70. Also, the shaking of the basket is also completely prevented.

Hereinafter, the fastening process of the rotation shaft, the pinion, the support wire and the shaking prevention cap will be explained.

First, the process which connects the rotation shaft 58 to the basket 50 will be described. A pair of shaking prevention caps 70 are positioned so that a center of rotation of the shaking prevention caps 70 is disposed on the extension line of the center of the rotation shaft hole 57. Here, the shaking prevention caps 70 have to be positioned so that a tip of the fixing hook 72 is directed to a side of the basket 50. And, the rotation shaft 58 is passed through the rotation shaft hole 57, shaking prevention cap 70, shaking prevention cap 70 and rotation shaft hole 57 in sequence.

After that, the pinion 60 is connected with one end of the rotation shaft 58. And, the shaking prevention cap 70 is moved to the outside of the basket 50, so that it is connected to the junction 64 of the pinion 60.

If the shaking prevention cap 70 is inserted into the junction 64 in a state that the tip of the fixing hook 72 is contacted with the tip of the junction 64, the fixing hook 72 is elastically deformed in a centrifugal direction of the shaking prevention cap 70. If the shaking prevention cap 70 is further inserted in a state that the fixing hook 72 is elastically deformed, the latch projection 73 of the fixing hook 72 is inserted into the connection groove 66. And, the fixing hook 72 is restored in a centripetal direction and returned to its original state, the shaking prevention cap 70 is fixed in the junction 64.

In this manner, after securing one end of the rotation shaft 58, the above-described process is also applied to the other end of the rotation shaft 58, and the pinion 60 and the shaking prevention cap 70 are connected.

Hereinafter, the process of installing the basket to the basket rail will be explained.

First, a worker hooks the hook wire 54 to the hook hole 46. And, in this state, the basket 50 is pushed toward the rear so that the pinion 60 is engaged with the rack 36.

And then, the basket 50 is integrally moved with the rotation shaft 58 and the pinion 60, and therefore the shaking which may be created when the basket moves is prevented. And, the friction between the hook wire 54 and the hook hole 46 is decreased because the shaking is prevented. Therefore, the phenomenon that the covering of the hook wire 54 composed of wires is peeled off may be prevented.

Here, the left and right positions of the basket may stably installed by the gear-free portion 61 after inserting the basket to the inner-most region, even though the left and right positions of the basket is estranged at a specific length by a pushing action of the basket. The same thing may happen while users push/pull the basket.

MODE FOR THE INVENTION

The present invention further includes the following embodiments.

First, the in order to prevent the rotation shaft from shaking, a hole of an appropriate size corresponding to the size of the rotation shaft may be provided in the support wire. In this case, a little vibration of the rotation shaft is also prevented. For an example, if the size of the end of the support wire and of the rotation shaft hole corresponds to the size of the rotation shaft, it is possible to more strongly support the rotation shaft.

According to the explanation of the present invention, a basket in which objects are received by a frame is suggested, however the present invention is not restricted thereto, the basket may be a typical storage box made of plastic and only the other parts are the same as the present invention.

According to the explanation of the present invention, the shaking prevention cap is connected to the pinion, however the present invention is not restricted thereto. There is no problem in maintaining the relative position of the pinion and the support wire as long as the position of the shaking prevention cap is maintained, even though the shaking prevention cap is connected to the rotation shaft and the support wire. However, the reliability in maintaining the relative position is increased by fastening the pinion with the shaking prevention cap.

According to the explanation of the present invention, the operation of the hook wire is essential, however the present invention is not restricted thereto, it is also possible to support the self weight of the basket by using a separate roller structure. However, the hook wire is preferably used, since the self weight of the basket and the foods received therein may be supported by the hook wire.

INDUSTRIAL APPLICABILITY

According to the present invention, there is advantages that the basket is stably installed and moved, and that the convenience of the user, the reliability of the operation and the comfortableness of the user are increased as the basket is applied to the apparatus such as a refrigerator. Also, since the shaking is prevented while moving the basket, the satisfaction of the user is increased. And, since the friction of each part constituting the basket is reduced or disappeared, the damage of the part is prevented and the operational reliability of the basket is improved. Particularly, it is expected that the reliability is increased when heavy objects are received in the basket.

The invention claimed is:

1. A basket operation device of a refrigerator, comprising:

a basket providing a food storage space and freely pushed in and pulled out of the refrigerator, the basket including a frame formed from a plurality of wires;

a hanger wire fastened to the basket;

a rail member configured to support the hanger wire and extended inside the refrigerator in a back-and-forth direction;

a rotation shaft supported by the basket and moved with the basket and respectively rotated;

a pair of pinions supported by both sides of the rotation shaft and configured to guide a movement of the basket when the basket moves in a back-and-forth direction;

a rack formed in the refrigerator in a back-and-forth direction to contact with the pinions;

a support wire coupled to the frame, the support wire being bent at both sides of the basket to support the pinions;

a shaft hole through which the rotation shaft is passed, the shaft hole being a space formed between the frame and the support wire; and a shaking prevention cap connected with one of the pinions, wherein the shaking prevention cap is coupled to the rotation shaft inside the support wire, and said one of the pinions is coupled to the shaking prevention cap outside the support wire.

2. The basket operation device of a refrigerator according to claim 1, wherein the rotation shaft is provided at a rear side of the basket.

3. The basket operation device of a refrigerator according to claim 1, wherein in case of inserting the basket, the position of the rotation shaft is disposed at an inner place than that of the rack.

4. The basket operation device of a refrigerator according to claim 1, wherein the position of the rack is fixed in an inner wall of the refrigerator.

5. The basket operation device of a refrigerator according to claim 1, wherein at least one of the pinions includes a gear configured to be rotatable and a junction configured to be installed into the shaft hole.

6. The basket operation device of a refrigerator according to claim 1, wherein said at least one of the pinions includes a connection groove stepped from an outside of the junction, and wherein the shaking prevention cap includes a fixing hook which is deformed to be inserted into the connection groove.

7. The basket operation device of a refrigerator according to claim 1, further comprising a fixing rib, which is provided in the shaking prevention cap, for indicating the position where said one of the pinions is fastened in order to indicate the position of said one of the pinions.

* * * * *